US010424847B2

(12) United States Patent
Isom et al.

(10) Patent No.: US 10,424,847 B2
(45) Date of Patent: Sep. 24, 2019

(54) WIDEBAND DUAL-POLARIZED CURRENT LOOP ANTENNA ELEMENT

(71) Applicant: Raytheon Company, Waltham, MA (US)

(72) Inventors: Robert S. Isom, Allen, TX (US); Larry C. Martin, Los Angeles, CA (US)

(73) Assignee: Raytheon Company, Waltham, MA (US)

( * ) Notice: Subject to any disclaimer, the term of this patent is extended or adjusted under 35 U.S.C. 154(b) by 146 days.

(21) Appl. No.: 15/698,929

(22) Filed: Sep. 8, 2017

(65) Prior Publication Data

US 2019/0081411 A1 Mar. 14, 2019

(51) Int. Cl.
*H01Q 1/48* (2006.01)
*H01Q 21/06* (2006.01)
(Continued)

(52) U.S. Cl.
CPC ..... *H01Q 21/061* (2013.01); *H01Q 1/48* (2013.01); *H01Q 5/50* (2015.01); *H01Q 7/00* (2013.01);
(Continued)

(58) Field of Classification Search
CPC ..... H01Q 21/06; H01Q 5/50; H01Q 1/48; H01Q 7/00; H01Q 9/0435; H01Q 9/30; H01Q 15/0026; H01Q 21/0006
See application file for complete search history.

(56) References Cited

U.S. PATENT DOCUMENTS 3,846,721 A 11/1974 Fritz et al.
4,686,536 A 8/1987 Allcock
(Continued)

FOREIGN PATENT DOCUMENTS

JP U-1992027609 3/1992
JP H07-106841 4/1995
(Continued)

OTHER PUBLICATIONS

European Examination Report for EP Appl. No. 13721516.6 dated Jun. 21, 2018; 6 pages.
(Continued)

*Primary Examiner* — Dieu Hien T Duong
(74) *Attorney, Agent, or Firm* — Daly, Crowley, Mofford & Durkee LLP

(57) ABSTRACT

A wideband dual-polarized current loop antenna element is provided having a ground tower and an antenna circuit integrated, such as within a multi-layer circuit board configuration. The antenna circuit includes feed conductors and element conductors, each of which are capacitively coupled to a top ground plane of the ground tower. The feed conductors are coupled to receive signals from coaxial feed lines coupled to the respective antenna element and element conductors are coupled to receive signals from adjacent antenna elements, such as in an antenna array configuration. The antenna element can further include one or more frequency selective surface (FSS) layers disposed proximate to the top ground plane of the ground tower and the antenna circuit. The ground tower, antenna circuit and one or more FSS layers can be formed to provide a low-profile antenna element having wide broadband performance.

21 Claims, 8 Drawing Sheets

(51) Int. Cl.

| | |
|---|---|
| ***H01Q 5/50*** | (2015.01) |
| ***H01Q 7/00*** | (2006.01) |
| ***H01Q 21/00*** | (2006.01) |
| ***H01Q 9/04*** | (2006.01) |
| ***H01Q 9/30*** | (2006.01) |
| ***H01Q 15/00*** | (2006.01) |

(52) U.S. Cl.
CPC ..... *H01Q 9/0435* (2013.01); *H01Q 9/30* (2013.01); *H01Q 15/0026* (2013.01); *H01Q 21/0006* (2013.01)

(56) References Cited

U.S. PATENT DOCUMENTS

| | | | |
|---|---|---|---|
| 5,172,082 | A | 12/1992 | Livingston et al. |
| 5,453,751 | A | 9/1995 | Tsukamoto et al. |
| 5,880,694 | A | 3/1999 | Wang et al. |
| 5,995,047 | A | 11/1999 | Freyssinier et al. |
| 6,147,648 | A | 11/2000 | Granholm et al. |
| 6,320,542 | B1 | 11/2001 | Yamamoto et al. |
| 6,424,298 | B1 | 7/2002 | Nishikawa et al. |
| 6,429,816 | B1 | 8/2002 | Whybrew et al. |
| 6,459,415 | B1 | 10/2002 | Pachal et al. |
| 6,512,487 | B1 | 1/2003 | Taylor et al. |
| 6,856,297 | B1 | 2/2005 | Durham et al. |
| 6,867,742 | B1 | 3/2005 | Irion, II et al. |
| 6,876,336 | B2 | 4/2005 | Croswell et al. |
| 6,977,623 | B2 | 12/2005 | Durham et al. |
| 7,012,572 | B1 | 3/2006 | Schaffner et al. |
| 7,084,827 | B1 | 8/2006 | Strange et al. |
| 7,109,821 | B2 | 9/2006 | Engargiola |
| 7,113,142 | B2 | 9/2006 | McCarville et al. |
| 7,138,952 | B2 | 11/2006 | Mcgrath et al. |
| 7,221,322 | B1 | 5/2007 | Durham et al. |
| 7,242,368 | B2 | 7/2007 | Thevenot et al. |
| 7,315,288 | B2 | 1/2008 | Livingston et al. |
| 7,358,921 | B2 | 4/2008 | Snyder et al. |
| 7,414,590 | B2 | 8/2008 | Bij De Vaate et al. |
| 7,675,466 | B2 | 3/2010 | Gaucher et al. |
| 7,688,265 | B2 | 3/2010 | Irion, II et al. |
| 7,948,441 | B2 | 5/2011 | Irion, II et al. |
| 8,106,846 | B2 | 1/2012 | Kikin |
| 8,154,466 | B2 | 4/2012 | Lewis et al. |
| 8,325,093 | B2 | 12/2012 | Holland et al. |
| 8,350,774 | B2 | 1/2013 | Pickles |
| 8,952,752 | B1 | 2/2015 | Huettner |
| 9,130,252 | B2 | 9/2015 | Isom et al. |
| 9,236,652 | B2 | 1/2016 | Kasemodel et al. |
| 9,343,816 | B2 | 5/2016 | Lee et al. |
| 9,437,929 | B2 | 9/2016 | Isom et al. |
| 9,537,208 | B2 | 1/2017 | Isom |
| 2003/0112200 | A1 | 6/2003 | Marino |
| 2004/0027291 | A1 | 2/2004 | Zhang et al. |
| 2005/0156802 | A1 | 7/2005 | Livingston et al. |
| 2006/0097947 | A1 | 5/2006 | McCarville et al. |
| 2008/0036665 | A1 | 2/2008 | Schadler |
| 2008/0169992 | A1 | 7/2008 | Ortiz et al. |
| 2009/0073075 | A1 | 3/2009 | Irion, II et al. |
| 2011/0210903 | A1* | 9/2011 | Sarabandi ..... H01Q 15/0086 343/904 |
| 2012/0146869 | A1 | 6/2012 | Holland et al. |
| 2013/0250536 | A1 | 9/2013 | Satake |
| 2015/0116174 | A1 | 4/2015 | Yona et al. |
| 2015/0123864 | A1 | 5/2015 | Boryssenko |
| 2018/0040955 | A1* | 2/2018 | Vouvakis ..... H01Q 9/285 |

FOREIGN PATENT DOCUMENTS

| | | | |
|---|---|---|---|
| JP | 2000-312112 | | 11/2000 |
| JP | 2006-504375 | A | 2/2006 |
| WO | WO 2009/077791 | A1 | 6/2009 |
| WO | WO 2016/138267 | A1 | 9/2016 |

OTHER PUBLICATIONS

Response to European Examination Report dated Jun. 21, 2018 for EP Appl. No. 13721516.6 as filed on Oct. 26, 2018; 18 pages.
Cavallo, et al.; "Analysis of Common-Mode Resonances in Arrays of Connected Dipoles and Possible Solutions;" Radar Conference; IEEE; Sep. 30, 2009; pp. 441-444; 4 Pages.
Final Office Action dated Dec. 3, 2015 from U.S. Appl. No. 13/674,547; 22 Pages.
Final Office Action dated Jul. 1, 2016 from U.S. Appl. No. 13/674,547; 30 Pages.
Hees, et al.; "Ultra Broadband Dual Polarized Dipole Array with Metallic Reflector;" International Conference on Ultra Wideband; IEEE; Sep. 9-11, 2009; pp. 744-747;4 Pages.
Japanese Office Action with English Translation dated Jun. 21, 2016 for Japanese Application No. 2015-541757; 8 pages.
Kindt, et al.; "Polarization Correction in Dual-Polarized Phased Arrays of Flared Notches;" Antennas and Propagation (APSURSI); IEEE International Symposium; Jul. 3-8, 2011; pp. 1961-1964; 4 Pages.
Kasemodel, et al.; "Broadband Planar Wide-Scan Array Employing Tightly Coupled Elements and Integrated Balun;" Phased Array Systems and Technology (ARRAY) 2010 IEEE International Symposium on; Oct. 12-15, 2010; pp. 467-472; 6 Pages.
Nesic, et al.; "Wideband Printed Antenna with Circular Polarization;" Antennas and Propagation Society International Symposium; Jul. 13, 1997; pp. 1882-1885; 4 Pages.
Notice of Allowance dated Jun. 6, 2016 from U.S. Appl. No. 14/155,440; 8 Pages.
Notice of Allowance dated Sep. 16, 2016 from U.S. Appl. No. 13/674,547; 17 Pages.
Notice of Preliminary Rejection with English Translation dated Feb. 27, 2016 for Korean Appl. No. 10-2015-7010618; 4 pages.
Office Action dated Jun. 8, 2015 from U.S. Appl. No. 13/674,547; 23 Pages.
Office Action dated Jan. 15, 2016 from U.S. Appl. No. 14/155,440; 29 Pages.
Office Action dated Apr. 7, 2016 from U.S. Appl. No. 13/674,547; 27 Pages.
PCT International Preliminary Report on Patentability for PCT/US2013/038408 dated May 21, 2015; 9 Pages.
PCT Search Report & Written Opinion of the ISA for PCT/US2013/038408 dated Jun. 28, 2013; 14 Pages.
Response to Communication Pursuant to Rules 161(1) and 162EPC as filed Jan. 19, 2016 for EP Application No. 13721516.6; 35 pages.
Response to Final Office Action dated Dec. 3, 2015 from U.S. Appl. No. 13/674,547, filed Feb. 22, 2016; 16 Pages.
Response to Final Office Action dated Jul. 1, 2016 from U.S. Appl. No. 13/674,547, filed Aug. 18, 2016; 14 Pages.
Response to Office Action dated Jun. 8, 2015 from U.S. Appl. No. 13/674,547, filed Aug. 28, 2015; 18 Pages.
Response to Office Action dated Jan. 15, 2016 from U.S. Appl. No. 14/155,440, filed Mar. 21, 2016; 18 Pages.
Response to Office Action dated Apr. 7, 2016 from U.S. Appl. No. 13/674,547, filed Jun. 21, 2016; 16 Pages.
Wong, et al.; "Broad-Band Single-Patch Circularly Polarized Microstrip Antenna with Dual Capacitively Coupled Feeds;" IEEE Transactions on Antennas and Propagation, vol. 49; No. 1; Jan. 2001; pp. 41-44; 4 Pages.
Wong, et al.; "Design of Dual-Polarized L-Probe Patch Antenna Arrays With High Isolation;" IEEE Transactions on Antennas and Propagation; vol. 52; No. 1; Jan. 2004; pp. 45-52; 8 Pages.
International Search Report dated Feb. 15, 2019 for International Application No. PCT/US2018/031497; 6 Pages.
Written Opinion of the ISA dated Feb. 15, 2019 for International Application No. PCT/US2018/031497; 11 Pages.
U.S. Appl. No. 16/415,292, filed May 17, 2019, Martin et al.
Elsallal et al., "Electronically Scanned Arrays of Dual-Polarized, Doubly-Mirrored Balanced Antipodal Vivaldi Antennas (DmBAVA) Based on Modular Elements;" IEEE Antennas and Propagation Society International Symposium, IET Conference; Jul. 9, 2006; 4 Pages.

(56) References Cited

OTHER PUBLICATIONS

Holland et al., "A 7-21 GHz Dual-Polarized Planar Ultrawideband Modular Antenna (PUMA) Array;" IEEE Transactions on Antennas and Propagation, vol. 60, No. 10; Oct. 2012; 12 Pages.
Holland et al., "A 7-21 GHz Planar Ultrawideband Modular Array;" 2010 IEEE Antennas and Propagation Society International Symposium (APSURSI); Aug. 2010; 4 Pages.
Holland et al., "Design and Fabrication of Low-Cost PUMA Arrays;" 2011 IEEE International Symposium on Antennas and Propagation (APSURSI); Jul. 8, 2011; 4 Pages.
Holland et al., "The Planar Ultrawideband Modular Antenna (PUMA) Array;" IEEE Transactions on Antennas and Propagation, vol. 60, No. 1; Jan. 2012; 11 Pages.
Kindt et al., "A 6:1 Bandwidth PUMA Array at 7mm Scale;" 2016 IEEE International Symposium on Phased Array Systems and Technology (APSURSI); Oct. 2016; 4 Pages.
Kindt et al., "Wavelength-Scaled Ultra-Wide Bandwidth Multi-Function Phased Arrays;" 2010 IEEE International Conference on Wireless Information Technology and Systems; Aug. 28, 2010; 4 Pages.
Kindt et al., "Ultrawideband All-Metal Flared-Notch Array Radiator;" IEEE Transactions on Antennas and Propagation, vol. 58, No. 11; Nov. 2010; 8 Pages.
Lee et al., "A Low-Profile Wide-Band (5:1) Dual-Pol Array;" IEEE Antennas and Wireless Propagation Letters, vol. 2; Jan. 2003; 4 Pages.
Lee et al., "Simplified Design of 6:1 PUMA Arrays;" 2015 IEEE International Symposium on Antennas and Propagation & USNC/URSI National Radio Science Meeting; Jul. 19, 2015; 2 Pages.
Lee et al., "Wide Band Bunny-Ear Radiating Element;" IEEE Transactions on Antennas and Propagation; Jun. 28, 1993; 4 Pages.
Livingston et al., "A Wide Band Low Profile Dual-Pol "Thumbtack" Array;" 2010 IEEE International Symposium on Phased Array Systems and Technology; Oct. 12, 2010; 4 Pages.
Logan et al., "A New Class of Planar Ultrawideband Modular Antenna Arrays with Improved Bandwidth;" IEEE Transactions on Antennas and Propagation, vol. 66, No. 2; Feb. 2018; 10 Pages.
Logan et al., "A Review of Planar Ultrawideband Modular Antenna (PUMA) Arrays;" Proceedings of the 2013 International Symposium on Electromagnetic Theory; May 20, 2013; 4 Pages.
Logan et al., "Opportunities and Advances in Ultra-Wideband Electronically Scanned Arrays;" 2016 IEEE International Symposium on Antennas and Propagation (APSURSI); Jun. 26, 2016; 2 Pages.
Ludwig, "The Definition of Cross Polarization;" IEEE Transactions on Antennas and Propagation; Jan. 1973; 4 Pages.
Munk et al., "A Low-Profile Broadband Phased Array Antenna;" IEEE Antennas and Propagation Society International Symposium, vol. 2; Jun. 2003; 4 Pages.
Schaubert et al., "Wide Bandwidth Arrays of Vivaldi Antennas;" 2008 Institution of Engineering and Technology Seminar on Wideband, Multiband Antennas and Arrays for Defense or Civil Applications (IET Conference); Mar. 13, 2008; 20 Pages.

* cited by examiner

WIDEBAND DUAL-POLARIZED CURRENT LOOP ANTENNA ELEMENT

BACKGROUND

As is known in the art, in array antennas, performance is often limited by the size and bandwidth limitations of the antenna elements which make up the array. Further, packaging volume constraints often require low profile antenna structures. Improving bandwidth while maintaining a low profile, which meets volume constraints, enables array system performance to meet bandwidth, scan, and volume packaging requirements of next generation communication systems, such as software defined or cognitive radio.

Attempts have been made to fabricate low profile antenna elements and array antennas. Such array antennas include an array of tightly coupled dipole elements which approximates the performance of an ideal current sheet, as well as so-called "bunny ear" antennas, and tightly coupled patch arrays. While these antenna element designs are all low profile, they either fail to operate over a desired bandwidth or require complex feed structures to support either dual linear or circular polarizations (e.g. requiring external components difficult to fit within the antenna element of an array antenna). Other antenna elements, such as Vivaldi notch antenna elements, can provide a relatively wide bandwidth, but are not low profile.

SUMMARY

In accordance with the concepts, systems, methods and techniques described herein a wideband current loop antenna element is provided having a ground tower and an antenna circuit integrated within a multi-layer circuit board design. The antenna circuit includes one or more feed conductors and one or more element conductors, each of which are capacitively coupled to a top ground plane of the ground tower. The feed conductors are disposed so as to couple signals to and/or from one or more coaxial feed lines which serve as input/output signal paths to the current loop antenna element. In embodiments, the wide band current loop antenna element may be provided having a pair of coaxial feed lines so as to provide the wideband current loop antenna element as a dual polarized wideband current loop antenna element.

When a plurality of such antenna elements are disposed to provide an array, the element conductors are coupled to receive signals from adjacent antenna elements, such as in an antenna array configuration.

The antenna element can further include one or more frequency selective surface (FSS) layers disposed proximate to the top ground plane of the ground tower and the antenna circuit (i.e., horizontal antenna circuit, whereby the antenna circuit is horizontal with respect to the ground tower). In an embodiment, the ground tower, antenna circuit and one or more FSS layers can be formed to provide a low-profile antenna element having broadband performance characteristics.

The ground tower (or ground structure) includes first and second ground planes (e.g., top and bottom ground planes) spaced apart and coupled together through one or more ground vias. Thus, in the antenna elements described herein each of the ground vias can be coupled to the same ground planes, as compared to typical antenna element designs having multiple or separate vertical grounding paths. The ground tower can be a vertical ground structure as it extends from the first ground plane to the second ground plane along a vertical distance within a unit cell forming the antenna element. As the ground tower can be coupled at the top and bottom of the vertical via structure within the antenna element (or within a unit cell of the antenna element), a shorter radio frequency (RF) ground path length, as compared to ground structures used in other low profile antenna elements, can be provided.

In an embodiment, the shorter RF ground path length can improve the high frequency performance of the antenna element and inhibit propagation of surface waves. High frequency may refer to a frequency in the range of about 2 GHz to about 50 GHZ (e.g., from the S-band range to the Q-band range). In some embodiments, high frequency may refer to frequencies above the Q-band frequency range. It should be appreciated that the antenna elements as described herein can be scaled to a variety of different frequencies with such frequencies selected based upon the needs of a particular application in which the antenna or antenna element is being used as well as upon capabilities of manufacturing technologies (e.g., printed wiring board (PWB) processing technology).

The feed conductors and the element conductors can be formed at substantially the same level (or same layer) within the antenna element such that they are spaced substantially the same distance from the second ground plane of the ground tower. In some embodiments, the feed conductors and the element conductors are separated by the second ground plane by one or more dielectric region. For example, in one embodiment, the feed conductors and the element conductors can be formed on or otherwise coupled to a first surface of a dielectric region and the second ground plane can be formed on or otherwise coupled to a second, different surface of the dielectric region. Each of the feed conductors and the element conductors can be capacitively coupled to the second ground plane. Thus, in some embodiment, there is no direct connection between the feed conductors and element conductors and the ground tower to provide improvement in low frequency isolation and cross-polarization performance.

The feed conductors may include first and second feed conductors coupled to receive RF signals from first and second coaxial feed lines respectively though first and second signal vias to provide dual polarization. For example, the second coaxial feed line can be configured to couple RF signals orthogonal to RF signals coupled to the first feed conductor by the first coaxial feed line such that the antenna element is responsive to RF signals having dual linear polarizations. The signal vias can be formed through one or more dielectric regions to couple the coaxial feed lines to the feed conductors. In an embodiment, the signal vias can be formed substantially parallel to the ground vias within the antenna element.

The element conductors may include first and second element conductors coupled to receive RF signals from adjacent antenna elements. For example, in an array antenna design, a portion (e.g., feed portion) of each of the element conductors can extend into adjacent antenna elements in the array. Thus, the first and second element conductors can be coupled through their respective feed portions to coaxial feed lines different antenna elements within the array.

The one or more FSS layers can be disposed proximate to the second ground plane, feed conductors and element conductors. In some embodiments, the one or more FSS layers may include wide angle impedance matching (WAIM) layers. The one or more FSS layers may include a plurality of selective regions (e.g., patch, slots, apertures). The selective regions can be configured to reflect or transmit signals from the antenna element at a frequency of interest or a band of frequencies of interest. In some embodiments, each of the selective regions may have the same geometric shape, such as but not limited to, a rectangular shape, a square shape, a circular shape. In embodiments having multiple FSS layers, the FSS layers can be disposed such that they are cascaded with respect to each other and separated by one or more dielectric regions.

Thus, a low profile, dual polarized, low cost antenna element that achieves wideband frequency and wide scan volume performance is provided. For example, the height (or depth, profile) of antenna elements described here having a combination of the ground tower, antenna circuit and FSS layers is relatively low compared with the profile of prior art antenna elements and array antennas having similar operating characteristics. In an embodiment, a height (or depth, profile) of a particular antenna element can be selected based at least in part on a desired bandwidth. For example, in applications requiring less bandwidth, the height of the antenna element can be reduced. For application requiring greater bandwidth, the height of the antenna element can be increased.

In a first aspect a radio frequency (RF) antenna element includes a ground tower having a first ground plane spaced from a second ground plane, the first and second ground planes coupled together through one or more ground vias, a first coaxial feed line coupled to provide signals to a first feed conductor, a second coaxial feed line coupled to provide signals to a second feed conductor, and first and second element conductors responsive to signals provided thereto. In an embodiment, the first and second feed conductors and first and second element conductors are capacitively coupled to the same second ground plane, producing a single ground structure within the unit cell.

With this particular arrangement, an antenna element capable of operating over a wide range of frequencies and a wide scan volume while maintaining a low profile is provided.

The antenna element may further include one or more frequency selective surface layers disposed proximate to the second ground plane, first and second feed conductors and first and second element conductors. Each of the one or more frequency selective surface layers can include a plurality of selective regions. In some embodiments, each of the selective regions have the same geometric shape.

The first and second feed conductors can be spaced a predetermined distance from the second ground plane in a vertical direction and/or a horizontal direction. In some embodiments, the first and second feed conductors and first and second element conductors are separated from the second ground plane by a dielectric region. The first and second feed conductors can have the same geometric shape and the first and second element conductors can have the same geometric shape.

The first and second element conductors can be coupled to receive signals from coaxial feed lines in adjacent antenna elements. In some embodiments, the first and second element conductors are spaced a predetermined distance from each other.

The second coaxial feed line can couples RF signals to the second feed conductor which are orthogonal to RF signals coupled to the first feed conductor by the first coaxial feed line such that the antenna element is responsive to RF signals having dual linear polarizations.

In another aspect, a multi-layered circuit board includes an element layer having first and second feed conductors and first and second element conductors and a first ground layer spaced from a second ground layer. The first and second ground layers coupled together through one or more ground vias and the second ground layer can be spaced from the element layer by a first dielectric region. The multi-layered circuit board may further include a second dielectric region disposed between the first and second ground layers, with the one or more ground vias are formed through the second dielectric region, and first and second coaxial feed lines coupled to provide signal to the first and second feed conductors receptively. The first and second coaxial feed lines are coupled to the first and second feed conductors through first and second signal vias formed through the first and second dielectric regions.

The second dielectric region may include a plurality of dielectric regions, and each of the dielectric regions can be coupled together by one or more adhesive layers. In some embodiments, each of the plurality of dielectric regions may include a conductive layer.

One or more frequency selective surface layers can be disposed proximate to the second ground plane, first and second feed conductors and the first and second element conductors. In some embodiments, one or more substrate layers, one or more dielectric regions and/or one or more adhesive layers disposed between the one or more frequency selective surface layers. The one or more frequency selective surface layers can include a plurality of selective regions. In some embodiments, the selective regions can have the same geometric shape.

The first and second signal vias can be disposed parallel to the one or more ground vias. The first and second feed conductors can be spaced a predetermined distance from the second ground plane in a vertical direction and a horizontal direction. The first and second element conductors can be coupled to receive signals from coaxial feed lines in adjacent antenna elements.

In another aspect, an array antenna includes a plurality of antenna elements. Each of the antenna elements includes a ground tower having a first ground plane spaced from a second ground plane, the first and second ground planes coupled together through one or more ground vias, a first coaxial feed line coupled to provide signals to a first feed conductor, a second coaxial feed line coupled to provide signals to a second feed conductor, and first and second element conductors spaced from each other; the first and second element conductors responsive to signals provided thereto. The first and second feed conductors and first and second element conductors are capacitively coupled to the second ground plane.

Each of the plurality of antenna elements may include one or more frequency selective surface layers disposed proximate to the second ground plane, first and second feed conductors and first and second element conductors. The first and second feed conductors and first and second element conductors can be separated from the second ground plane by a dielectric region in each of the plurality of antenna elements.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

The foregoing features may be more fully understood from the following description of the drawings in which like reference numerals indicate like elements.

DETAILED DESCRIPTION

Figure 1:
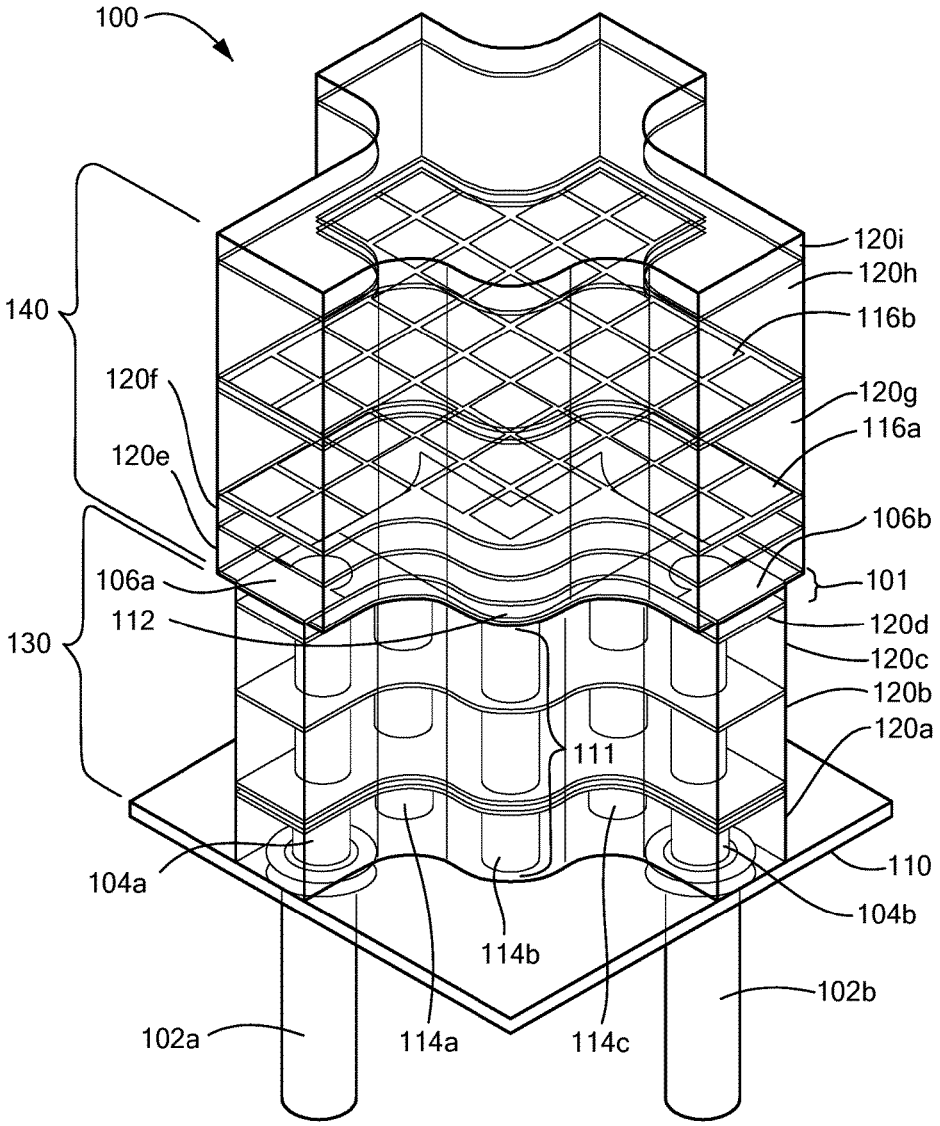
FIG. 1 shows an isometric view of a wideband dual polarized current loop antenna element.

Referring now to FIG. 1, an antenna element 100 includes first and second portions 130, 140 with first portion 130 having a ground tower 111, an antenna circuit 101 (e.g., an element conductors 107*a*, 107*b* and feed circuits 105) and second portion 140 having one or more frequency selective surface (FSS) layers 116*a*, 116*b* with two such layers here being shown. For reasons which will become apparent herein below, such an arrangement results in an antenna element having a relatively low-profile and which is capable of operating over a frequency bandwidth and scan volume which are relatively wide compared with prior art antennas having a similar low profile.

Ground tower 111 includes a first ground plane 110, a second ground plane 112 and a plurality of ground vias (i.e., electrically conductive vias) 114*a*-114*c* (here three) coupling first ground plane 110 to second ground plane 112. In some embodiments, first ground plane 110 is a backplane of antenna element 100. In other embodiments, first ground plane 110 can be a conductive layer formed over a backplane of antenna element 100.

It should be appreciated that ground tower 111 can include any number of ground vias 114, based at least in part on properties of the respective antenna element and/or a particular application of the antenna element. For example, in some embodiments, ground tower 111 may include four ground vias 114 coupling first ground plane 110 to second ground plane 112.

Ground tower 111 can be formed as a vertical ground structure such that it extends in a vertical direction from the first ground plane 110 to the second ground plane 112 within antenna element 100. In an embodiment, ground tower 111 can be integrated within antenna element 100 to form one or more layers of a multi-layer circuit board. For example, each of first and second ground planes 110, 112 and feed conductors 106*a*, 106*b* can be formed at different levels within the multi-layer circuit board configuration, as will be described in greater detail below with respect to FIG. 2.

Feed circuit 105 includes first and second feed conductors 106*a*, 106*b* coupled to first and second coaxial feed lines 102*a*, 102*b* through first and second signal vias 104*a*, 104*b*, respectively. In an embodiment, first and second feed conductors 106*a*, 106*b* and element conductors (e.g., element conductors 107*a*, 107*b* of FIGS. 3-3B) can form a horizontal antenna circuit 101 within first portion 130 (horizontal with respect to ground tower 111), as will be described in greater detail below.

First and second feed conductors 106*a*, 106*b* can be disposed and coupled to different coaxial feed lines so as to allow antenna element 100 to receive orthogonally polarized radio frequency (RF) signals. For example, and as illustrated in FIG. 1, first feed conductor 106*a* is coupled to first coaxial feed line 102*a* through a first signal via 104*a* and second feed conductor 106*b* is coupled to second coaxial feed line 102*b* through a second signal via 104*b*. First and second coaxial feed lines 102*a*, 102*b* may include coaxial feeds.

First and second feed conductors 106*a*, 106*b* can be capacitively coupled to the second ground plane 112 of ground tower 111. For example, in some embodiments, first and second feed conductors 106*a*, 106*b* can be spaced a predetermined distance from second ground plane 112 in a vertical direction, horizontal direction or both. In some embodiments, each of first and second feed conductors 106*a*, 106*b*, first and second signal vias 104*a*, 104*b*, and first and second feed lines 102*a*, 102*b* are spaced a predetermined distance from ground tower 111 and thus, there is not direct physical connection between the components of ground tower 111 (e.g., first and second ground planes 110, 112, plurality of ground vias 114*a*-114*c*) and first and second feed conductors 106*a*, 106*b*, first and second signal vias 104*a*, 104*b*, and first and second feed lines 102*a*, 102*b*.

First and second feed conductors 106*a*, 106*b* may be provided from any electrical conductor (e.g., a metallic material) or any material electrically responsive to RF signals provided thereto. First and second feed conductors 106*a*, 106*b* may be formed having the same or substantially same geometric shape. In other embodiments, first and second feed conductors 106*a*, 106*b* may have different geometric shapes. It should be appreciated that first and second feed conductors 106*a*, 106*b* may be formed in a variety of different shapes, including but not limited to any regular or irregular geometric shape. The shape of first and second feed conductors 106*a*, 106*b* can be selected based, at least in part, on the dimensions of antenna element 100 and/or a particular application of antenna element 100.

One or more frequency selective surface (FSS) layers 116*a*, 116*b* can be disposed within antenna element 100. For example, and as illustrated in FIG. 1, first and second FSS layers 116*a*, 116*b* are disposed proximate to (e.g., over) first and second feed conductors 106*a*, 106*b* and second ground plane 112. In some embodiments, FSS layers 116*a*, 116*b* may include wide amplitude impedance matching (WAIM) layers. FSS layers 116*a*, 116*b* will be described in greater detail below with respect to FIG. 4.

Antenna element 100 may be provided having one or more dielectric regions 120*a*-120*i* disposed between different layers to provide separation between the respective layers (e.g., dielectric spacing). For example, in some embodiments, a predetermined distance between two or more layers may correspond to a thickness of one or more of dielectric regions 120*a*-120*i*. In one embodiment, first and second feed conductors 106*a*, 106*b* can be dielectrically spaced from second ground plane 112.

Figure 2:
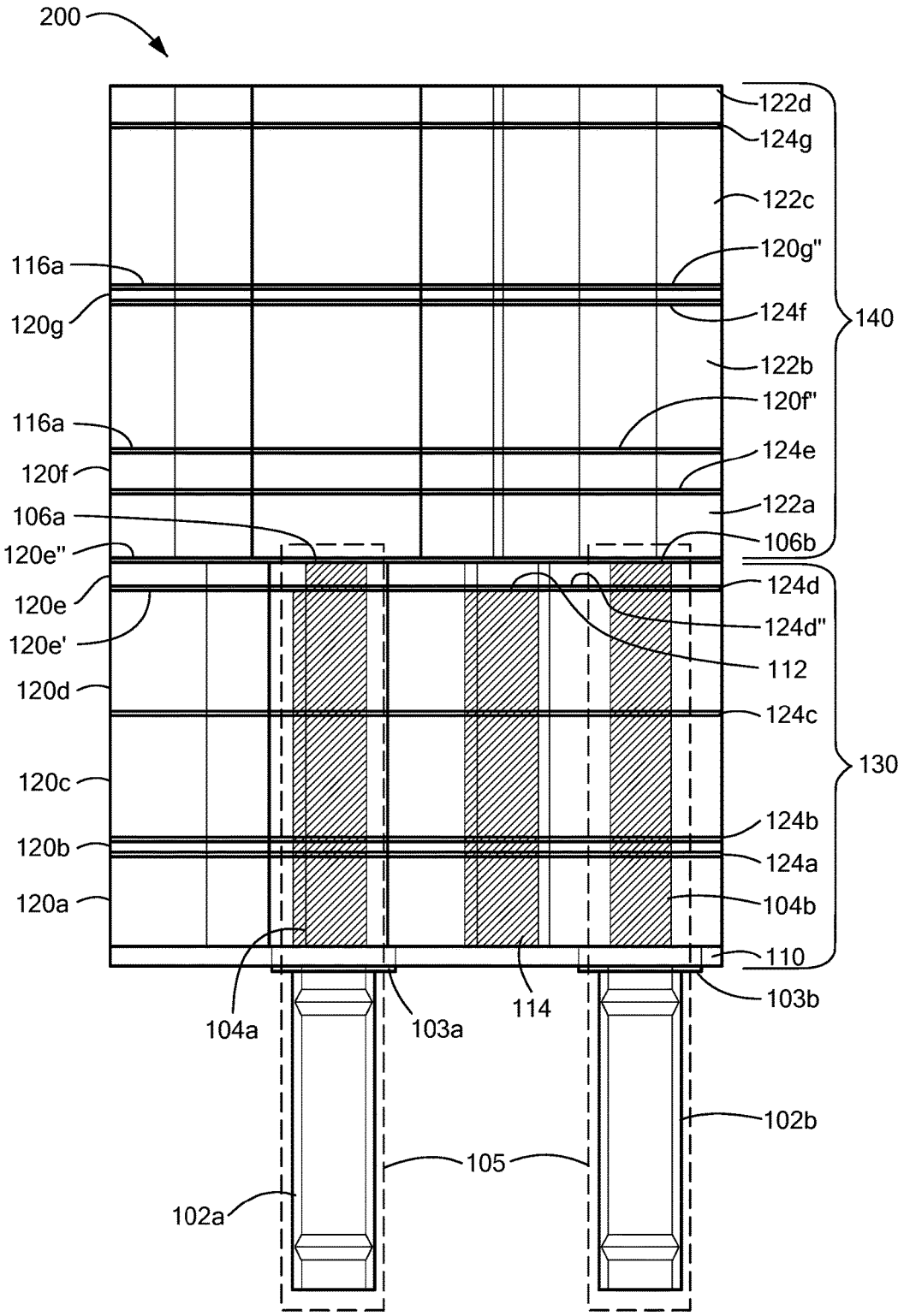
FIG. 2 shows a side view of the wideband dual polarized current loop antenna element of FIG. 1.

Dielectric regions 120*a*-120*i* can be coupled together using adhesive layers 124*a*-124*g*, as illustrated in FIG. 2. In some embodiments, conductive layers (e.g., metal layers) may be formed on (e.g., using any additive or subtractive PWB processing techniques) or otherwise coupled to one or more surfaces of the dielectric regions 120*a*-120*i*. For example, second ground plane 112 may be provided as conductive layer formed on a surface of a dielectric region, as will be discussed in greater detail with respect to FIG. 2. Dielectric regions 120*a*-120*i* and adhesive layers 124*a*-124*g* will be described in greater detail below with respect to FIG. 2.

In an embodiment, the space between first and second feed conductors 106*a* and 106*b* to second ground plane 112 can include a dielectric (e.g., one or more of dielectric regions 120*a*-120*i*). However, in other embodiments, the dielectric material on either side of first and second feed conductors 106*a* and 106*b* can be removed to improve radiator performance by producing a lower dielectric constant in the cavity surrounding the ground tower structure 111 of the unit cell of the antenna element 100.

First and second ground planes 110, 112 may be provided from any electrical conductive material (e.g., a metallic material).

First and second coaxial feed lines (or more simply "coaxial feeds") 102*a*, 102*b* may be provided having an outer conductor and a center conductor separated from the outer conductor by a dielectric (e.g., air or a dielectric material sometimes referred to as a dielectric jacket). In some embodiments, a center conductor of each of first and second coaxial feed lines 102*a*, 102*b* can be coupled to first and second signals vias 104*a*, 104*b* respectively. For example, a portion of the outer conductor can be removed to expose the center conductor and dielectric and the center conductor can be directly coupled the respective signal via. In an embodiment, the dielectric may prevent the center conductor from contacting any portions of ground tower 111. In other embodiments, the outer conductor may stop at a surface of the backplane of antenna element 100 and thus the dielectric may isolate the center conductor from first ground plane 100. In other embodiments, the outer conductor may extend into antenna element 100 and thus through ground plane 110 and/or a backplane of antenna element 100. In such an embodiment, an interface (e.g., interface 103*a*, 103*b* of FIG. 2) may be used to isolate coaxial feed lines 102*a*, 102*b* from first ground plane 100. The interface 103*a*, 103*b* will be described in greater detail below with respect to FIG. 2.

First and second coaxial feed lines 102*a*, 102*b* may be provided as feeds from different coaxial feed circuits. It should be appreciated that although first and second coaxial feed lines 102*a*, 102*b* are described herein as coaxial feed lines, those of ordinary skill it the art will recognize that coaxial feed lines 102*a*, 102*b* may be provided as one of a variety of different types of transmission lines including but not limited to any type of strip transmission line (e.g. a flex line, a microstrip line, a stripline, or the like). In still other embodiments, the coaxial feed lines 102*a*, 102*b* may be provided as conductive via hole (or more simply "a via"), a probe, or an exposed center conductor of a coaxial line. In still other embodiments, the coaxial feed lines 102*a*, 102*b* may be provided as a coplanar waveguide feed line (either with or without a ground) or from as a slotline feed line. Those of ordinary skill in the art will understand how to select the particular manner in which to implement (fabricate) coaxial feed lines 102*a*, 102*b* for a particular application. Some factors to consider in selecting the type of feed line to use for a particular application include but are not limited to frequency of operation, fabrication simplicity, cost, reliability, operating environment (e.g. operating and storage temperature ranges, vibration profiles, etc.).

Now referring to FIG. 2, in which like elements of FIG. 1 are provided having like reference numerals, antenna element 100 includes a first portion (or bottom portion) 130 and a second portion (or top portion) 140. Each of first portion 130 and second portion 140 include one or more one or more dielectric layers 120*a*-120*i* disposed between different components or layers of antenna element 100 to provide dielectric spacing.

In an embodiment, first portion 130 and second portion 140 can be described having a multi-layer circuit board configuration. For example, first portion 130 includes feed conductors 106*a*, 160*b* disposed at an element layer (or antenna circuit level), second ground plane 112 disposed at a second ground layer and first ground plane 110 disposed at a first ground layer. Further, one or more dielectric regions 120*a*-120*i* can be disposed between the element layer, second ground layer and/or first ground layer. Second portion 140 includes multiple FSS layers 116*a*, 116*b* with a combination of dielectric regions 120*a*-120*i*, substrate layers 122*a*-122*d* disposed between and/or proximate to them.

As illustrated in FIG. 2, first portion 130 includes multiple dielectric regions with a first dielectric region 120*a* disposed over a first surface 110*a* of a first ground plane 110 (e.g., metal backplane). First dielectric region 120*a* is coupled to a second dielectric region 120*b* by a first adhesive layer 124*a* and second dielectric region 120*b* is coupled to a third dielectric region 120*c* by a second adhesive layer 124*b*. Third dielectric region 120*c* is coupled to a fourth dielectric region 120*d* by a third adhesive layer 124*c* and fourth dielectric region 120*d* is coupled to a fifth dielectric region 120*e* by a fourth adhesive layer 124*d*.

Second ground plane 112 may be formed on or otherwise coupled to a surface of fourth adhesive layer 124*d*. For example, and as illustrated in FIG. 2, second ground plane 112 is coupled to a second surface of fourth dielectric region 124*d*". Thus, second ground plane 112 is disposed between the second surface 124*d*" of fourth adhesive layer 124*d* and a first surface 120*e*' of fifth dielectric region 120*e*.

First and second feed conductors 106*a*, 106*b* are coupled to or otherwise formed on a second surface of 120*e*" of fifth dielectric region 120*e*. Thus, in the illustrative embodiment of FIG. 2, first and second feed conductors 106*a*, 106*b* are spaced from second ground plane 112 by fifth dielectric region 120*e*.

Figure 3:
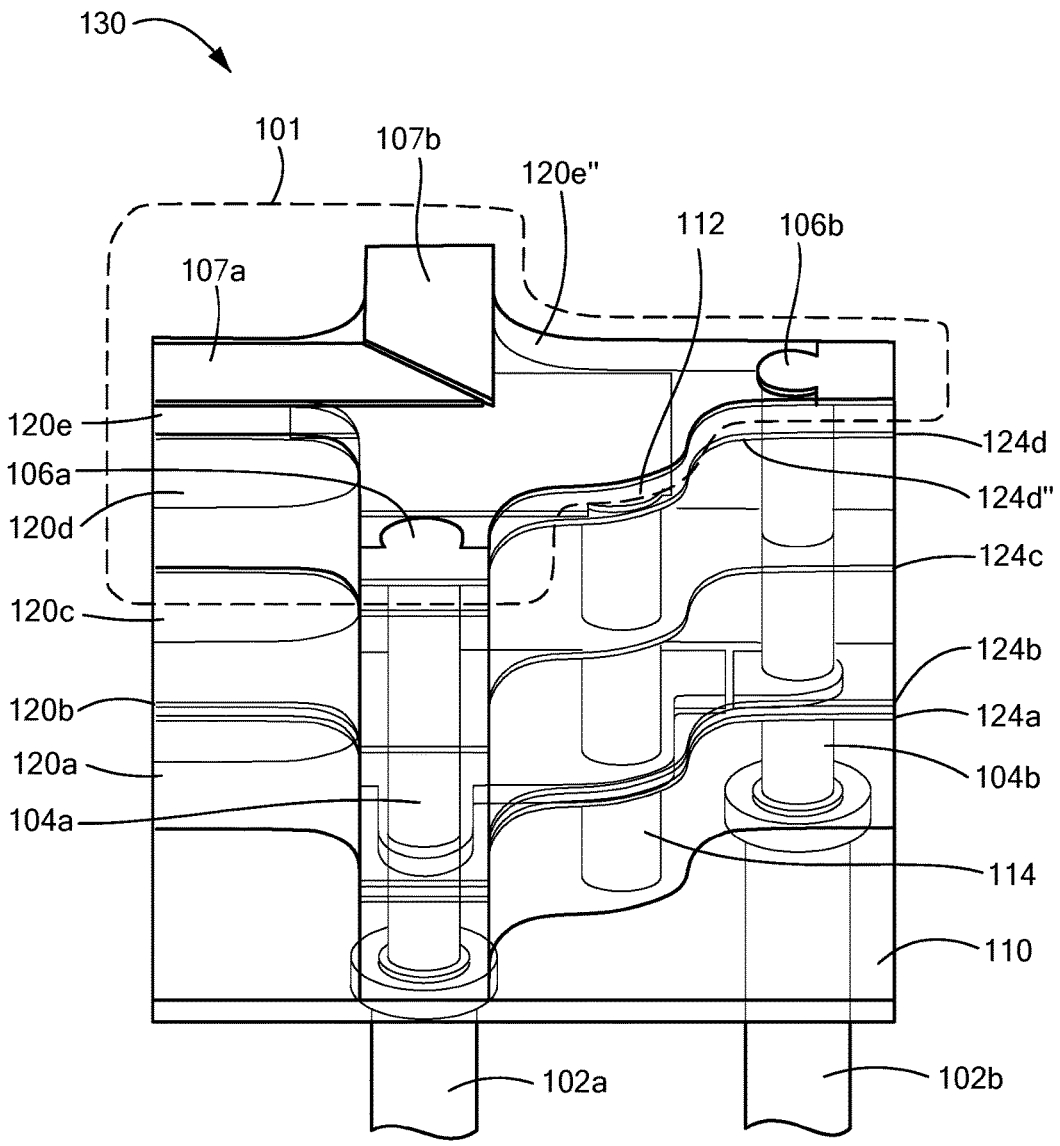
FIG. 3 shows a first isometric view of a bottom portion of the antenna element of FIG. 1 having the ground structure and element conductors.
Figure 3A:
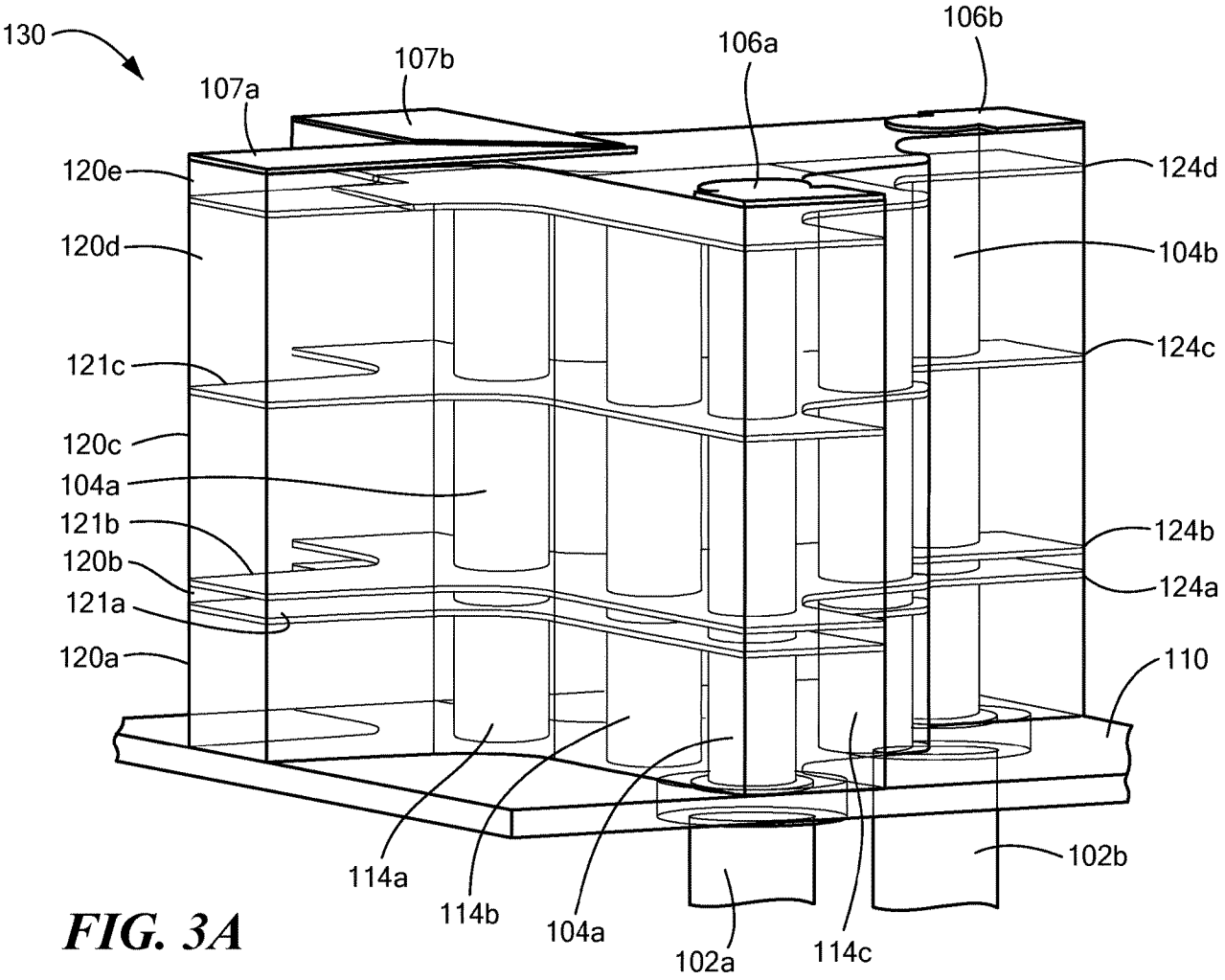
FIG. 3A shows a second isometric view of the bottom portion of the antenna element of FIG. 1 having the ground structure and element conductors.
Figure 3B:
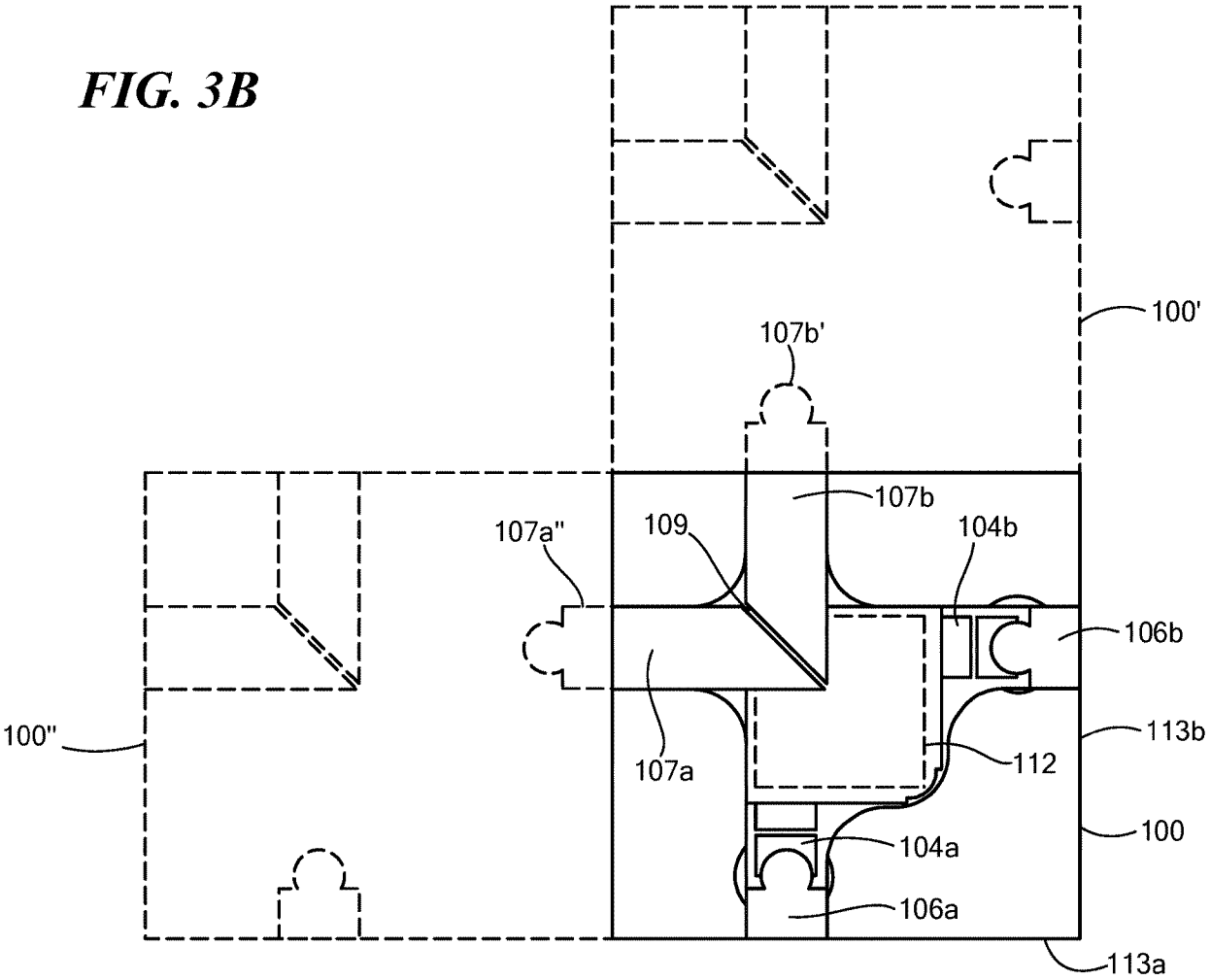
FIG. 3B shows a top view of the antenna element of FIGS. 3-3A.

It should be appreciated that first and second element conductors 107*a*, 107*b* (as illustrated in FIGS. 3-3B) can be coupled to the second surface of 120*e*" of fifth dielectric region 120*e* and disposed at the same level within antenna element 100 as first and second feed conductors 106*a*, 106*b*. Thus, in some embodiments, a distance between first and second feed conductors 106*a*, 106*b* and first and second element conductors 107*a*, 107*b* may correspond to a thickness of one or more dielectric regions, here fifth dielectric region 120*e*. First and second feed conductors 16*a*, 106*b* and first and second element conductors 107*a*, 107*b* can form a horizontal antenna circuit 101 at an element level within antenna element 100.

In first portion 130, first and second ground planes 110, 112 are coupled together through one or more ground vias 114 (here one). Although one ground via is illustrated in FIG. 2, it should be appreciated that first and second ground planes 110, 112 can be coupled together through a plurality of ground vias 114. Ground via 114 is formed through dielectric regions 120*a*-120*d* and adhesive layers 124*a*-124*c*. Ground via 114 and first and second ground planes 110, 112 form ground tower 111 within first portion 130.

First coaxial feed line 102*a* is coupled to first feed conductor 106*a* through a first signal via 104*a*. In an embodiment, first signal via 104*a* is formed through dielectric layers 120*a*-120*e* and adhesive layers 124*a*-124*c*. In an embodiment, first coaxial feed line 102*a* and first signal via 104*a* do not physically contact first ground plane 210. For example, a hole or interface 103*a* may be formed in first ground plane 110 to isolate first coaxial feed line 102*a* and first signal via 104*a* from first ground plane 110. In an embodiment, interface 103*a* may be provided as a metal plate having an aperture (or hole) sized to allow or otherwise fit first coaxial feed line 102*a* through. In other embodiments, interface 103*a* can include additional vertical via structures formed within antenna element 100 or a variety of different types of connectors, such as but not limited to molded connectors, to first coaxial feed line 102*a* to antenna element 100. In some embodiments, first coaxial feed line 102*a* can be machined coupled to antenna element 100.

Second coaxial feed line 102*b* is coupled to a second feed conductor 106*b* through a second signal via 104*a*. Second signal via 104*b* is formed through dielectric layers 120*a*-120*e* and adhesive layers 124*a*-124*c*. In an embodiment, first and second signal vias 104*a*, 104*b* can be formed such that they are substantially parallel to ground via 114. A hole or interface 103*b* can be formed in first ground plane 110 to isolate second coaxial feed line 102*b* and second signal via 104*b* from first ground plane 110. Thus, second coaxial feed line 102*b* and second signal via 104*b* do not physically contact first ground plane 110. In an embodiment, interface 103*b* may be provided as a metal plate having an aperture (or hole) sized to allow or otherwise fit second coaxial feed line 102*b* through. In other embodiments, interface 103*b* can include additional vertical via structures formed within antenna element 100 or a variety of different types of connectors, such as but not limited to molded connectors, to second coaxial feed line 102*b* to antenna element 100. In some embodiments, second coaxial feed line 102*b* can be machined coupled to antenna element 100.

Second portion 140 may include dielectric regions 120, adhesive layers 124, substrate layers 122, FSS layers 116 or one or more combinations of them. For example, and as illustrated in FIG. 2, a first substrate layer 122*a* is disposed on or otherwise on first and second feed conductors 106*a*, 106*b* and portions of fifth dielectric layer 120*e*. In an embodiment, an adhesive layer 124 may be provided between first substrate layer 122*a* and first and second feed conductors 106*a*, 106*b* and portions of fifth dielectric layer 120*e*.

First substrate layer 122*a* is coupled to a sixth dielectric region 120*f* by a fifth adhesive layer 124*e*. A first FSS layer 116*a* may be formed on or otherwise coupled to a second surface 120*f'* of sixth dielectric region 120*f*. In some embodiments, first FSS layer 116*a* may be formed over a portion of second surface 120*f'* (e.g., not the entire second surface) of sixth dielectric region 120*f*. First FSS layer 116*a* will be described in greater detail below with respect to FIG. 4.

A second substrate layer 122*b* is coupled to or otherwise formed over first FSS layer 116*a* and/or portions of second surface 120*f'* sixth dielectric region 120*f*. Second substrate layer 122*b* is coupled to a seventh dielectric region 120*g* by a sixth adhesive layer 124*f*. A second FSS layer 116*b* may be formed on or otherwise coupled to a second surface 120*g*" of seventh dielectric region 120*g*. In some embodiments, second FSS layer 116*b* may be formed over a portion of second surface 120*g*" (e.g., not the entire second surface) of seventh dielectric region 120*g*. Second FSS layer 116*b* will be described in greater detail below with respect to FIG. 4.

A third substrate layer 122*c* is coupled to or otherwise formed over second FSS layer 116*b* and/or portions of second surface 120*g*" seventh dielectric region 120*g*. A fourth substrate layer 122*d* is coupled to third substrate layer 122*c* by a seventh adhesive layer 124*g*.

It should be appreciated that FIG. 2 illustrates one example embodiment of antenna element 100 and that antenna element 100 and thus each of first portion 130 and second portion 140 can formed having one or more dielectric regions 120, one or more adhesive layers 124 and/or one or more substrate layers 122. For example, in some embodiments, the number of regions and/or layers can correspond to a desired height (or depth) the respective antenna element. The height can be selected based at least in part on a desired bandwidth for the antenna element. For applications requiring less bandwidth, the height of the antenna element can be reduced and for application requiring greater bandwidth, the height of the antenna element can be increased. Thus, antenna element 100 can be formed having a low-profile while meeting required bandwidth and scan requirements of a particular application.

Dielectric regions 120*a*-120*i* may include dielectric material. For example, in some embodiments, dielectric regions 120*a*-120*i* may be provided from dielectric material of the type manufactured by Rogers Corporation, Rogers, Conn. laminate material (e.g., RO 4350, RO 4360, RO 5880 LZ, RO 6002, etc.).

Substrate layers 122*a*-122*d* may include various forms of structural foam materials or structural foam cores, such as but not limited to Rohacell structural foam (e.g., Rohacell 71).

Adhesive layers 124*a*-124*g* may include a variety of different forms of adhesive or glue materials used to bond or otherwise couple multiple layers together. For example, in some embodiments, adhesive layers 124*a*-124*g* may be provided in the form of prepreg sheets used to bond dielectric regions 120*a*-120*i* together, substrate layers 122*a*-122*d* together or a combination of them.

Now referring to FIGS. 3-3B, in which like reference numerals indicate like elements and in which like elements of FIG. 1 are provided having like reference numerals, first portion 130 of antenna element 100 is illustrated with second portion 140 removed. As illustrated in FIGS. 3-3B, first and second element conductors 107*a*, 107*b* are disposed over second surface 120*e*" of fifth dielectric region 120*e* and thus disposed at the same level as first and second feed conductors 106*a*, 106*b*.

First and second element conductors 107*a*, 107*b* and first and second feed conductors 106*a*, 106*b* are spaced from second ground plane 112 by fifth dielectric region 120*e*. Thus, first and second element conductors 107*a*, 107*b* can be spaced the same distance from second ground plane 112 as first and second feed conductors 106*a*, 106*b*. In some embodiments, first and second element conductors 107*a*, 107*b* and first and second feed conductors 106*a*, 106*b* can be spaced from second ground plane 112 by multiple dielectric regions. First and second element conductors 107*a*, 107*b* and first and second feed conductors 106*a*, 106*b* can be capacitively coupled to second ground plane 112.

It should be appreciated that FIG. 3 and FIG. 3A, both illustrate first portion 300, just from different angles. For example, FIG. 3A provides a rotated view as compared to FIG. 3 to better illustrate the multiple ground vias 114*a*-114*c* coupling first ground plane 110 to second ground plane 112.

As illustrated in FIGS. 3-3A, first coaxial feed line 102*a* is coupled to first element conductor 306*a* through a first signal via 304*a* and a second feed line 302*b* is coupled to a second element conductor 306*b* through second signal via 304*b*.

First and second ground planes 110, 112 are spaced from each other by multiple dielectric regions 120*a*-120*d* and adhesive layers 124*a*-124*c*. First ground plane 110 may correspond to a backplane of first portion 130 and second ground plane 112 can be formed on a second surface 124*d*" of fourth adhesive layer 124*d*. First, second and third ground vias 114*a*, 114*b*, 114*c* are formed through dielectric regions 120*a*-120*d* and adhesive layers 124*a*-124*c* to couple first and second ground planes 110, 112 and form ground tower 111.

The one or more of dielectric regions 120*a*-120*e* may include conductive layers 121*a*-121*c* disposed over one or more surfaces of the respective dielectric regions 120*a*-120*e*. Conductive layers 121*a*-121*c* can be provided within antenna element 100 to provide impedance matching functionality, improve loss performance (e.g., return loss, insertion loss) and maintain cross-polarization and port isolation. Conductive layers 121*a*-121*c* can be formed on dielectric regions disposed between first and second ground planes 110, 112.

In some embodiments, first and second ground planes 110, 112 may be provided as conductive layers formed on a surface of a dielectric region (i.e., as discussed above with respect to FIG. 2). For example, first ground plane 110 can be a conductive layer formed over a backplane of antenna element 100. Second ground plane can be a conductive layer formed over dielectric region 120*e* and coupled to adhesive layer 124*d*.

FIG. 3B is a top view of first portion 130 of FIGS. 3 and 3A. As illustrated in FIG. 3B, first and second element conductors 107*a*, 107*b* are orthogonally disposed (i.e., centerlines of each conductor are orthogonal) and are spaced from each other by a gap 109. In an embodiment, first and second element conductors 107*a*, 107*b* can be spaced from each other by gap 109 to improve electrical isolation and cross-polarization performance over scan of antenna element 100, as compared to other antenna elements having similar operating characteristics. Thus, in an embodiment, the dimensions of gap 109 (i.e., the spacing or distance between first and second element conductors 107*a*, 107*b*) can be selected based at least in part on a particular application of antenna element 100 and desired performance requirements (e.g., cross-polarization isolation) of antenna element 100.

As also illustrated in FIG. 3B, each of first and second feed conductors 106*a*, 106*b* and first and second element conductors 107*a*, 107*b* are disposed over second surface 120*e*" of fifth dielectric region 120*e* and spaced from each other along the second surface 120*e*" of fifth dielectric layer 120*e*. For example, in one embodiment, first and second feed conductors 106*a*, 106*b* and first and second element conductors 107*a*, 107*b* do not contact each other (i.e., no physical connection). In the example of FIG. 3B, conductors 106*a*, 106*b* are disposed on adjacent sides (or edges or adjacent sides of a unit cell) of the antenna element 100.

Second ground plane 112 (shown here with dashed lines for clarity) is disposed under (i.e., opposing surface of dielectric substrate 120*e* from the surface on which conductors 106*a*, 106*b*, 107*a*, 107*b* are disposed) fifth dielectric region 120*e* such that each of first and second feed conductors 106*a*, 106*b* and first and second element conductors 107*a*, 107*b* are spaced apart by a distance corresponding to a thickness of fifth dielectric region 120*e* from second ground plane 112.

First and second element conductors 107*a*, 107*b* may be provided from any electrical conductor (e.g., a metallic material, such as but not limited to copper) or any material electrically responsive to RF signals provided thereto. First and second element conductors 107*a*, 107*b* may be formed having the same or substantially same geometric shape (e.g., knife-edge shape, rectangular shape, circular shape, etc.). In other embodiments, first and second element conductors 107*a*, 107*b* may have different geometric shapes. It should be appreciated that first and second element conductors 107*a*, 107*b* may be formed in a variety of different shapes, including but not limited to any regular or irregular geometric shape. The shape of first and second element conductors 107*a*, 107*b* can be selected based, at least in part, on the dimensions of antenna element 100 and/or a particular application of antenna element 100 and a desired response to RF signals.

It should be appreciated that first and second element conductors 107*a*, 107*b* are not coupled to first or second coaxial feed lines 102*a*, 102*b* disposed within first portion 130. For example, and as illustrated in FIG. 3B, first and second element conductors 107*a*, 107*b* can be coupled to coaxial feed lines and signal vias in adjacent antenna elements 100', 100" (e.g., adjacent to first portion 130 of antenna element 100 in an array configuration) and thus fed signals from the respective adjacent antenna elements 100', 100".

First and second element conductors 107*a*, 107*b* may correspond to a different portion of feed conductors disposed in adjacent antenna elements 100', 100" and be coupled to feed conductors (feed points) in the adjacent antenna elements 100', 100". For example, and as illustrated in FIG. 3B, second element conductor 107*b* can be coupled to a feed conductor 107*b*' that is part of adjacent antenna element 100' and coupled to receive signals from coaxial feed lines in adjacent antenna element 100'. First element conductor 107*a* can be coupled to a feed conductor 107*a*" that is part of adjacent antenna element 100" and coupled to receive signals from coaxial feed lines in adjacent antenna element 100". In some embodiments, first element conductor 107*a* and feed conductor 107*a*" can be a single conductor having portions disposed in two adjacent antenna elements, here antenna elements 100, 100", and second element conductor 107*b* and feed conductor 107*b*' can be a single conductor having portions disposed in two adjacent antenna elements, here antenna elements 100, 100'. The array configuration will be described in greater detail below with respect to FIGS. 5-5A.

In some embodiments having a single antenna element 100, one or more partial antenna element structures having a ground tower (e.g., ground tower 111 of FIG. 1) and a feed circuit (e.g., feed circuit 105 of FIG. 1) may be formed along one or more edges of the respective antenna element 100. For example, in such embodiments, adjacent antenna elements 100', 100" may be formed as partial antenna element structures having a ground tower and feed circuit to provide feeds to first and second feed conductors 107*a*, 107*b*. In embodiments having a single antenna element 100, the single antenna element 100 may be formed without first and second feed conductors 106*a*, 106*b* formed along first and second edges 113*a*, 113*b* of the respective antenna element 100.

Figure 4:
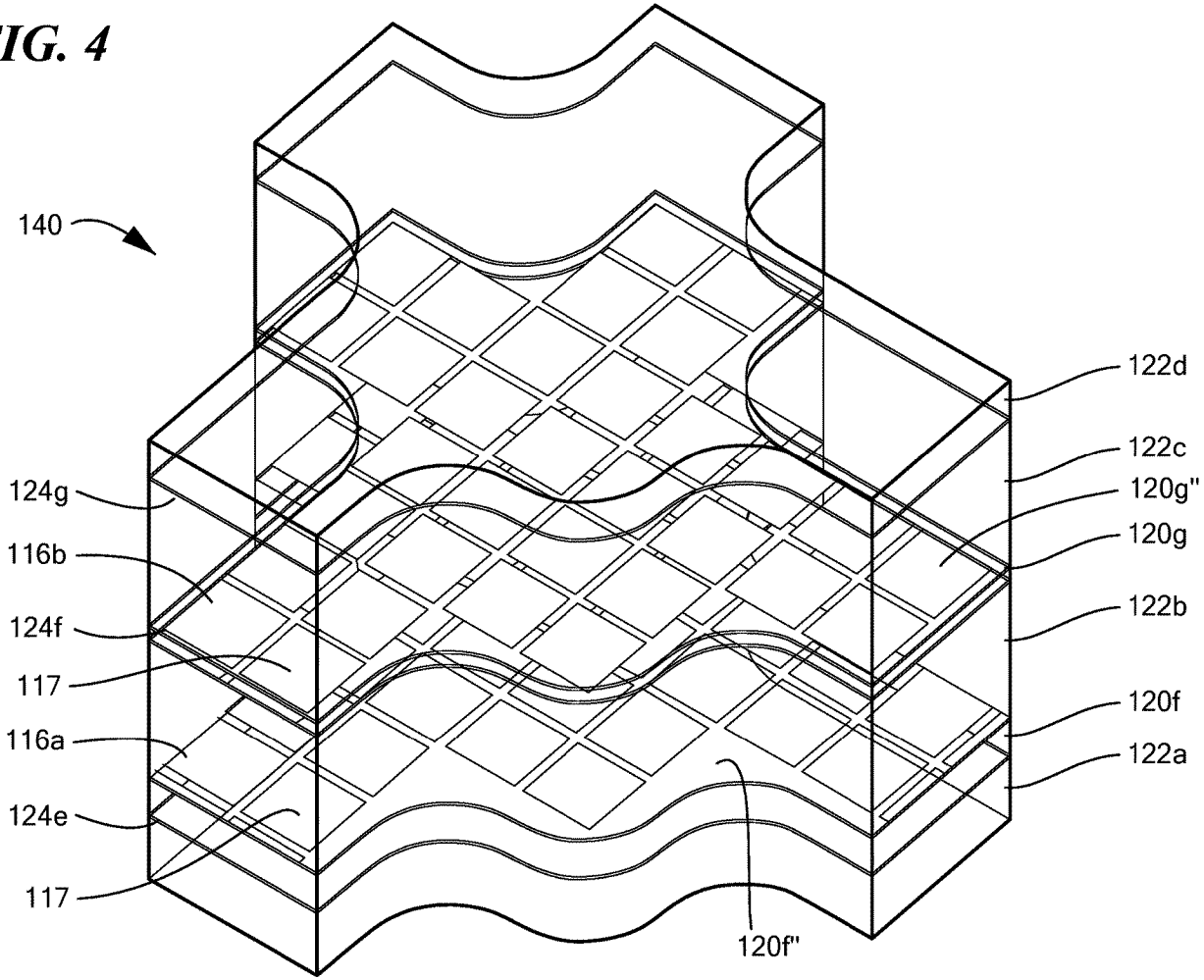
FIG. 4 shows an isometric view of a top portion of the antenna element of FIG. 1 having the frequency selective surface layers.

Now referring to FIG. 4, in which like elements of FIG. 1 are provided having like reference numerals, second portion 140 of antenna element 100 includes multiple dielectric regions 120*f*-120*g*, substrate layers 122*a*-122*d*, adhesive layers 124*e*-124*g* and FSS layers 116*a*-116*b*.

First and second FSS layers 116*a*, 116*b* are coupled to or otherwise formed on second surfaces 120*f*', 120*g*" of sixth and seventh dielectric regions 120*f*, 120*g* respectively. Each of first and second FSS layers 116*a*, 116*b* include a plurality of selective regions 117. Selective regions 117 may be provided as or include patches, slots, or apertures. Selective regions 117 can be configured to reflect or transmit signals from antenna element 100 at a frequency of interest or a band of frequencies of interest. In an embodiment, the frequency of interest or a band of frequencies of interest can be selected based at least in part on a particular application of antenna element 100.

Selective regions 117 can be formed (e.g., using any additive or subtractive techniques, such as sputtering or patterning) on a surface of the respective dielectric region as a single layer and then bonded to a respective substrate layer (e.g., substrate layers 122*a*-122*d*) disposed proximate to the surface of the respective dielectric region.

In some embodiments, each of selective regions 117 may have the same geometric shape, such as but not limited to, a rectangular shape, a square shape, a circular shape. In other embodiments, one or more selective regions 117 may have different geometric shapes.

It should be appreciated that although FIG. 4 illustrates two FSS layers 116*a*, 116*b*, antenna element 100 can be formed having any number of FSS layers 116. For example, in some embodiments, antenna element 100 may include a single FSS layer 116. In other embodiments, antenna element 100 may include more than two FSS layers 166. The number of FSS layers 116 included within a respective antenna element can be selected based at least in part on a particular application of the antenna element and/or design requirement of the antenna element (e.g., cost, height, complexity, etc.). In embodiments having multiple FSS layers 116, the FSS layers 116 can be disposed such that they are cascaded with respect to each other and separated by one or more dielectric regions.

In some embodiments, dielectric regions 120*f*-120*g* disposed in second portion 140 may not include conductive layers (e.g., conductive layers 121*a*-121*c* of first portion 130). In other embodiments, dielectric regions 120*f*-120*g* may include conductive layers disposed over one or more surfaces of respective dielectric regions 120*f*-120*g*.

Now referring to FIG. 5, an array antenna (hereinafter array) 200 includes a plurality of antenna elements 201*a*-201*p*. Each of antenna elements 201*a*-201*p* may be the same as or substantially similar to antenna element 100 of FIGS. 1-4.

Figure 5:
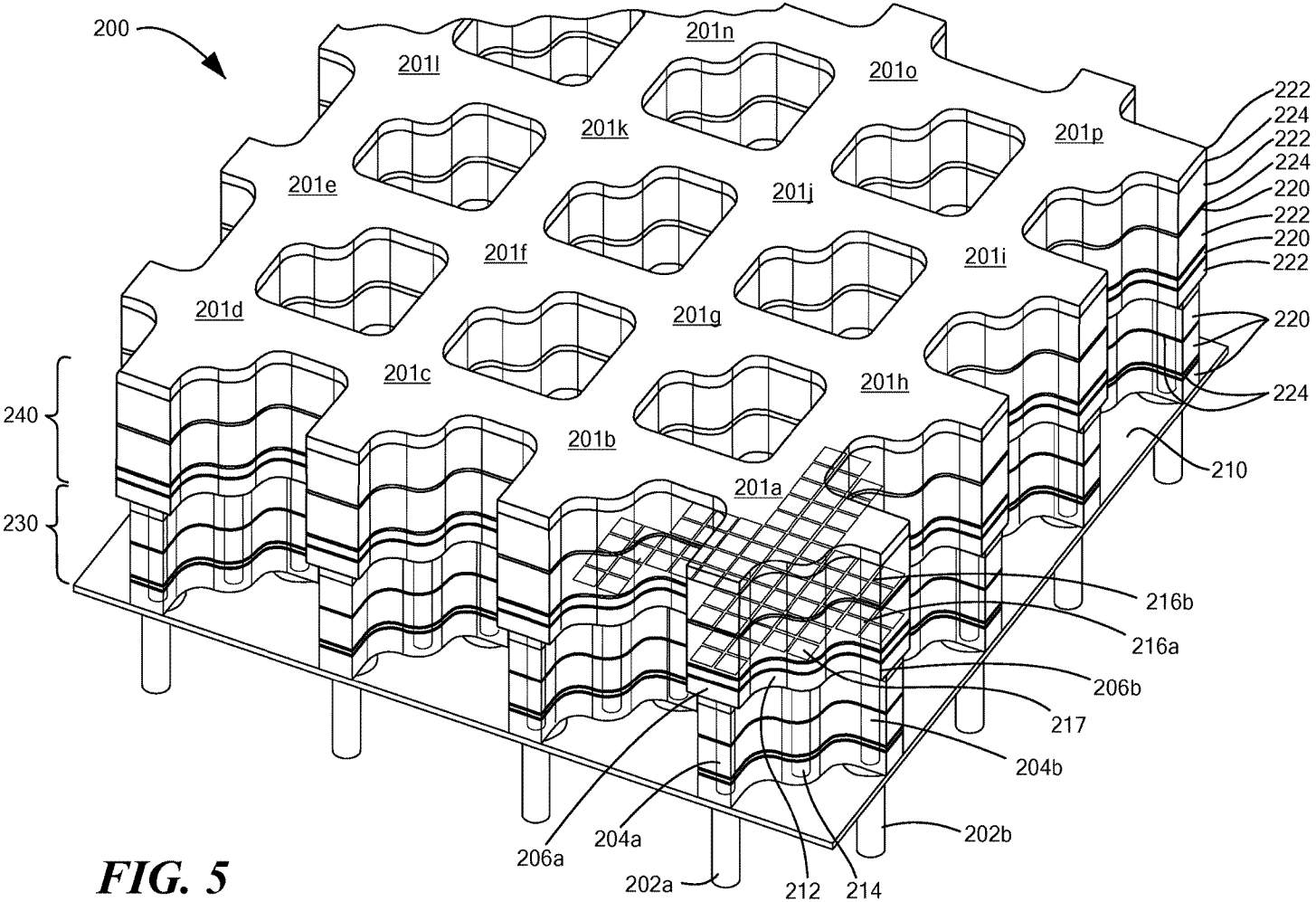
FIG. 5 shows an isometric view of an array antenna provided from a plurality of the antenna elements of FIG. 1.

As illustrated in FIG. 5, each of antenna elements 201*a*-201*p* includes a first portion 230 having a ground tower and horizontal antenna circuit components and a second portion 240 having one or more FSS layers. For example, first portion 230 includes first and second coaxial feed lines 202*a*, 202*b* coupled to first and second feed conductors 206*a*, 206*b* through first and second signal vias 204*a*, 204*b*. The ground tower of first portion 230 includes a first ground plane 210 (here a backplane of array 200) coupled to a second ground plane 212 by one or more ground vias 214.

First portion 230 further includes one or more dielectric regions 220 and one or more adhesive layers 224. In some embodiments, dielectric regions 220 and/or adhesive layers 224 can be disposed within first portion 230 as described above with respect to first portion 130 of FIG. 2. However, it should be appreciated that first portion 230 can be formed having various configurations of dielectric regions 220 and/or adhesive layers 224 and varying numbers of dielectric regions 220 and/or adhesive layers 224. In some embodiments, the configuration of and/or the number of dielectric regions 220 and/or adhesive layers 224 can be selected based at least in part on a particular application of array 200 and/or the properties of array 200 (e.g., mechanical and electrical characteristics including but not limited to height, depth, bandwidth).

First and second signal vias 204*a*, 204*b* can be formed through dielectric regions 220 and adhesive layers 224 to couple first and second coaxial feed lines 202*a*, 202*b* to first and second feed conductors 206*a*, 206*b*, respectively. Ground vias 214 can be formed through dielectric regions 220 and adhesive layers 224 to couple first and second ground planes 210, 212 together.

Second portion 240 includes first and second FSS layers 216*a*, 216*b* disposed between a combination of substrate layers 222, dielectric regions 220, and adhesive layers 224. In some embodiments, substrate layers 222, dielectric regions 220, and/or adhesive layers 224 can be disposed within second portion 240 as described above with respect to second portion 140 of FIG. 2. However, it should be appreciated that second portion 240 can be formed having various configuration of FSS layers 216, substrate layers 222, dielectric regions 220, and/or adhesive layers 224 and varying numbers of FSS layers 216, substrate layers 222, dielectric regions 220, and/or adhesive layers 224. In some embodiments, the configuration of and/or the number of FSS layers 216, substrate layers 222, dielectric regions 220, and/or adhesive layers 224 can be selected based at least in part on a particular application of array 200 and/or the properties of array 200 (e.g., height, depth, bandwidth).

In the illustrative embodiment of FIG. 5, first FSS layer 216*a* is formed on (e.g., patterned on) or otherwise coupled to a second surface of a dielectric region 220 and second FSS layer 216*b* is formed on (e.g., patterned on) or otherwise coupled to a second surface of a different dielectric region 220. First and second FSS layers 216*a*, 216*b* include one or more selective regions 217. In some embodiments, the selective regions 217 of first and second FSS layers 216*a*, 216*b* can have the same geometric shape. In other embodiments, the selective regions 217 of first FSS layer 216*a* can have different geometric shapes than the selective regions 217 of second FSS layer 216*b*.

In some embodiments, dielectric regions 220 and/or adhesive layers 224 formed in array 200 may extend through the first portions 230 of each of the antenna elements 201*a*-201*p* within array 200 such that they share the respective dielectric regions 220 and/or adhesive layers 224. In other embodiments, each of antenna elements 201*a*-201*p* within array 200 may have separate dielectric regions 220 and/or adhesive layers 224.

In some embodiments, dielectric regions 220, substrate layers 222 and/or adhesive layers 224 formed in array 200 may extend through the second portions 240 of each of the antenna elements 201*a*-201*p* within array 200. In other embodiments, the second portions 240 of each of antenna elements 201*a*-201*p* within array 200 may have separate dielectric regions 220, substrate layers 222 and/or adhesive layers 224.

Figure 5A:
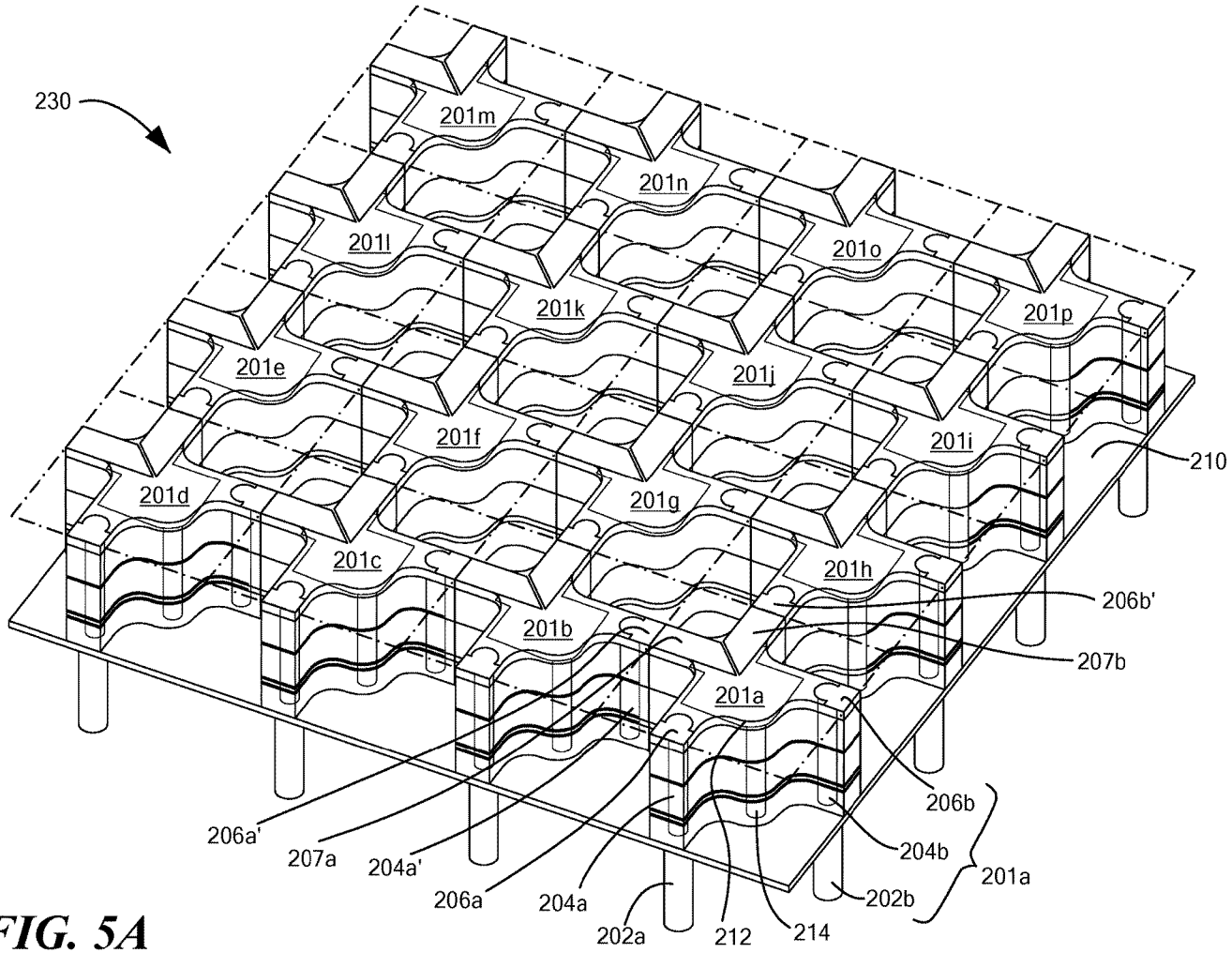
FIG. 5A shows an isometric view of the array antenna of FIG. 5 with a top portion removed to expose the bottom portion. having a plurality of the antenna elements of FIG. 1.

Now referring to FIG. 5A, first portion 230 is shown with second portion 240 removed to expose a top surface of first portion 230. As illustrated in FIG. 5A, each first portion 230 of each of antenna elements 201*a*-201*p* includes first and second element conductors 207*a*, 207*b*. First and second element conductors 207*a*, 207*b* may be the same as or substantially similar to first and second element conductors 107*a*, 107*b* described above with respect to FIGS. 3-3B.

First and second element conductors 207*a*, 207*b* are coupled to feed conductors (or feed points) 206*a*', 206*b*' disposed in adjacent antenna elements 201*b*, 201*h*, respectively. Thus, first and second element conductors 207*a*, 207*b* can be fed signals from the adjacent antenna elements 201*b*, 201*h* within array 200. For example, in some embodiments, first and second element conductors 207*a*, 207*b* are part of or extensions of feed conductors 206*a*',206*b*' that extend into antenna element 201*a*.

As illustrated in FIG. 5A, feed conductor 206*a*' is coupled to a coaxial feed line (not shown) through signal via 204*a*' within antenna element 201*b*. Thus, signals provided to feed conductor 206*a*' by a coaxial feed line can be provided to first element conductor 207*a*. Feed conductor 206*b*' is coupled to a coaxial feed line (not shown) through signal via 204*b*' within antenna element 201*h*. Thus, signals provided to feed conductor 206*b*' by a coaxial feed line can be provided to second element conductor 207*b*.

Each pairing of element conductors 207*a*, 207*b* within each of antenna elements 201*a*-201*p* can be spaced apart from each other a predetermined distance. The predetermined distance can be selected based at least in part on a particular application of array 200 and/or performance requirements (e.g., isolation requirements, cross-polarization performance over scan) of array 200.

In some embodiments, one or more partial antenna element structures having a ground tower (e.g., ground tower 111 of FIG. 1) and a feed circuit (e.g., feed circuit 105 of FIG. 1) may be formed along one or more edges of array 200 to provide feeds for feed conductors 106*a*, 106*b* disposed along the respective edges of array 200. In other embodiment, feed conductors 106*a*, 106*b* disposed along one or more edges of array 200 may be removed or otherwise not formed.

Having described preferred embodiments, which serve to illustrate various concepts, structures and techniques, which are the subject of this patent, it will now become apparent that other embodiments incorporating these concepts, structures and techniques may be used. Accordingly, it is submitted that the scope of the patent should not be limited to the described embodiments but rather should be limited only by the spirit and scope of the following claims.

What is claimed:

1. A radio frequency (RF) antenna element comprising:

a ground tower having a first ground plane spaced from a second ground plane, the first and second ground planes coupled together through one or more ground vias;

a first coaxial feed line disposed to couple signals to a first feed conductor;

a second coaxial feed line disposed to couple signals to a second feed conductor; and first and second element conductors responsive to signals provided through the first and second feed conductors respectively;

wherein the first and second feed conductors and first and second element conductors are spaced apart from and capacitively coupled to the second ground plane and wherein the first and second element conductors are physically isolated from the first ground plane.

2. The antenna element of claim 1, further comprising one or more frequency selective surface layers disposed proximate to the second ground plane, first and second feed conductors and first and second element conductors.

3. The antenna element of claim 2, wherein each of the one or more frequency selective surface layers include a plurality of selective regions, wherein each of the selective regions have the same geometric shape.

4. The antenna element of claim 1, wherein the first and second feed conductors are spaced a predetermined distance from the second ground plane in a vertical direction and a horizontal direction.

5. The antenna element of claim 1, wherein the first and second feed conductors and first and second element conductors are separated from the second ground plane by a dielectric region.

6. The antennal element of claim 1, wherein the first and second feed conductors have the same geometric shape and the first and second element conductors have the same geometric shape.

7. The antenna element of claim 1, wherein the first and second element conductors are coupled to receive signals from coaxial feed lines in adjacent antenna elements.

8. The antenna element of claim 1, wherein the first and second element conductors are spaced a predetermined distance from each other.

9. The antenna element of claim 1, wherein the second coaxial feed line couples RF signals to the second feed conductor which are orthogonal to RF signals coupled to the first feed conductor by the first coaxial feed line such that the antenna element is responsive to RF signals having dual linear polarizations.

10. A multi-layered circuit board comprising:

an element layer having first and second feed conductors and first and second element conductors;

a first ground layer spaced from a second ground layer, the first and second ground layers coupled together through one or more ground vias, wherein the second ground layer is spaced from the element layer by a first dielectric region; and a second dielectric region disposed between the first and second ground layers, wherein the one or more ground vias are formed through the second dielectric region; and first and second coaxial feed lines disposed to couple signals to the first and second feed conductors receptively, wherein the first and second coaxial feed lines are coupled to the first and second feed conductors through first and second signal vias formed through the first and second dielectric regions, wherein the first and second element conductors are responsive to the signals provided through the first and second feed conductors respectively and wherein the first and second element conductors are physically isolated from the first ground layer.

11. The multi-layered circuit board of claim 10, wherein the second dielectric region comprises a plurality of dielectric regions, and each of the dielectric regions are coupled together by one or more adhesive layers.

12. The multi-layered circuit board of claim 11, wherein each of the plurality of dielectric regions include a conductive layer.

13. The multi-layered circuit board of claim 10, further comprising one or more frequency selective surface layers disposed proximate to the second ground plane, first and second feed conductors and the first and second element conductors.

14. The multi-layered circuit board of claim 13, further comprising one or more dielectric regions or one or more adhesive layers disposed between the one or more frequency selective surface layers.

15. The multi-layered circuit board of claim 13, wherein each of the one or more frequency selective surface layers include a plurality of selective regions, wherein each of the selective regions have the same geometric shape.

16. The multi-layered circuit board of claim 10, further comprising the first and second signal vias disposed parallel to the one or more ground vias.

17. The multi-layered circuit board of claim 10, wherein the first and second feed conductors are spaced a predetermined distance from the second ground plane in a vertical direction and a horizontal direction.

18. The multi-layered circuit board of claim 10, wherein the first and second element conductors are coupled to receive signals from coaxial feed lines in adjacent antenna elements.

19. An array antenna comprising:

a plurality of antenna elements, each of the antenna elements comprising:

a ground tower having a first ground plane spaced from a second ground plane, the first and second ground planes coupled together through one or more ground vias;

a first coaxial feed line disposed to couple signals to a first feed conductor;

a second coaxial feed line disposed to couple signals to a second feed conductor; and first and second element conductors spaced from each other; the first and second element conductors responsive to signals provided through the first and second feed conductors respectively;

wherein the first and second feed conductors and first and second element conductors are capacitively coupled to the second ground plane and wherein the first and second element conductors are physically isolated from the first ground plane.

20. The array antenna of claim 19, wherein each of the plurality of antenna elements further comprise one or more frequency selective surface layers disposed proximate to the second ground plane, first and second feed conductors and first and second element conductors.

21. The array antenna of claim 19, wherein the first and second feed conductors and first and second element conductors are separated from the second ground plane by a dielectric region in each of the plurality of antenna elements.

* * * * *